US005222540A

United States Patent [19]

Varga

[11] Patent Number: 5,222,540

[45] Date of Patent: Jun. 29, 1993

[54] ARTICULATED WINDOW COVERING PANELS

[76] Inventor: Harvey P. Varga, 341 Jersey St., San Francisco, Calif. 94114

[21] Appl. No.: 753,108

[22] Filed: Aug. 30, 1991

[51] Int. Cl.[5] ..... E06B 9/00

[52] U.S. Cl. ..... 160/222; 160/193; 160/202

[58] Field of Search ..... 160/222, 202, 34, 32, 160/193

[56] References Cited

U.S. PATENT DOCUMENTS 188,136 3/1877 Hoffman ..... 160/222 X
1,321,587 11/1919 Barnard ..... 160/222 X
1,788,651 1/1931 Alderson ..... 160/193
2,531,797 11/1950 Wellman ..... 160/222

*Primary Examiner*—Blair M. Johnson
*Attorney, Agent, or Firm*—Flehr, Hohbach, Test, Albritton & Herbert

[57] ABSTRACT

A set of window covering panels may be raised or lowered from a header mounted upon the window casing. Pull cords and drop cords on the panels permit the panels to be raised and lowered one at a time or all at a time. Guide members keep the panels in vertical alignment and cam surfaces permit one panel to slide up behind the next higher panel when shifting the panels into a nested condition.

7 Claims, 10 Drawing Sheets

FIGURE 5-A

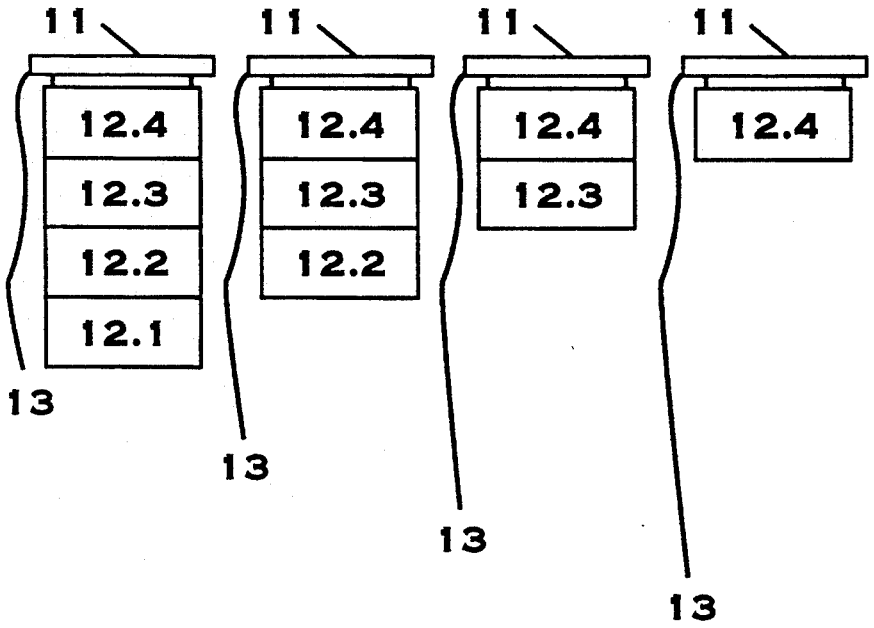
FIGURE 8
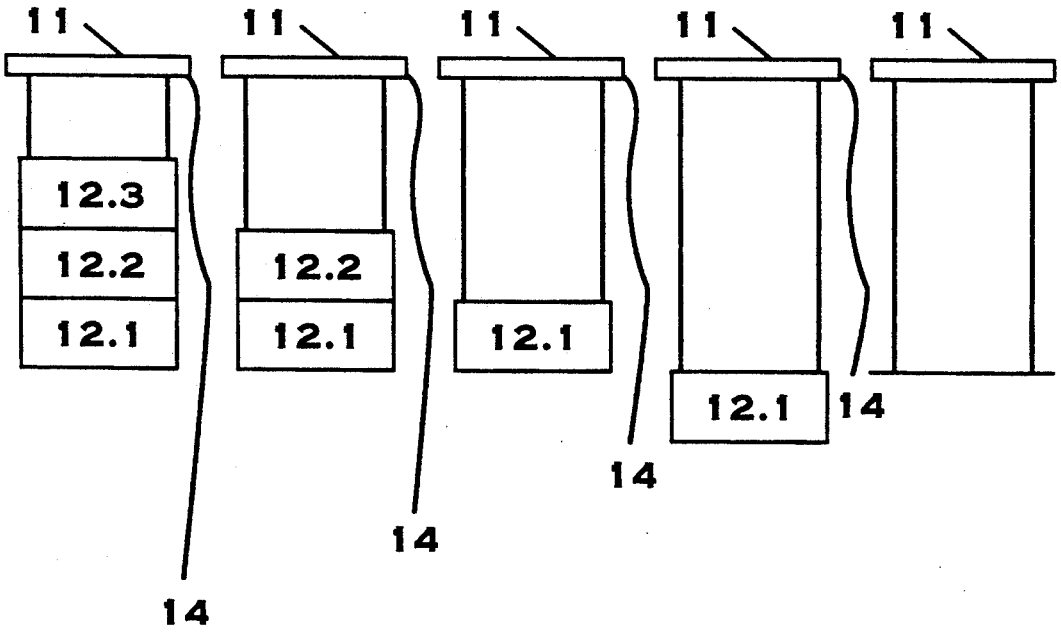
FIGURE 8–A

ARTICULATED WINDOW COVERING PANELS

FIELD OF THE INVENTION

This invention relates to window coverings such as shades, blinds or the like and particularly concerns an improved system of non-flexible panels which may be displayed or retracted from covering a window opening so as to furnish selectively either a "blind" effect or an aesthetic effect such as an artistic scene.

BACKGROUND OF THE INVENTION

Developments in the field of window coverings may be categorized generally as flexible window coverings such as curtains and roller blinds and like and semi-flexible window coverings such as venetian blinds and Roman shades. Shoii screens, which can be considered to be an arrangement of non-flexible articulated panels, are found occasionally serving as window coverings. All of these designs have received widespread application.

Designs to cover window openings with sets of panels are shown in the U.S. Patents to Barnard, U.S. Pat. No. 1,321,587 of Nov. 11, 1919; the patent to Bennerscheidt, U.S. Pat. No. 881,455 of Mar. 10, 1908 and the patent to Stratton, U.S. Pat. No. 129,435 of Jul. 16, 1872. An articulated set of panels to serve as a theater curtain was disclosed in the Hoffmann patent, U.S. Pat. No. 188,136 of Mar. 6, 1877. All of these designs are either complicated to make and install, cumbersome to operate or are insufficiently attractive to the home maker for display in a house of contemporary design.

SUMMARY OF THE INVENTION

The invention in summary includes a set of non-flexible, generally rectilinear panels carried by a horizontally disposed header to be mounted on a window casing. The individual panels have a perimeter frame and a sheet of fabric or the like material mounted on the frame to serve the function of a blind or to depict an artistic scene or design running through the several panels in the set. So that the panel set may nest in one retracted condition and are kept in alignment when deployed, guide means are positioned on the vertical frame bars or stiles and include a longitudinally extending stationary portion cooperable with a slider member carried by an adjacent panel. The slider member moves along the elongate element as the panels are raised or lowered. Guide surfaces on the upper and lower frame bars of the panels permit a camming action as a lower panel is moved upwardly against the next higher panel so the lower panel may move onto one side of the higher panel to occupy an overlying position. Thus all the panels in set may nest together in an area of vertical plane not substantially larger than the area of a typical panel. A cord system mounted on the header and connected with the panel set serves for raising and lowering the panel set.

A general object of the invention is to provide an improved system of window covering which is attractive and simple in design, easy to fabricate and install and which is operable to either completely cover the window opening as in a fully deployed condition or to be placed into an out of the way condition leaving the window opening substantially unobstructed.

Another object is to provide a panel system to serve as a window covering in which the panels may be deployed selectively in fewer than all in the set at several different positions in the window opening.

Another object is to provide a system of the type described wherein the panel frame may be formed from wood, metal or rigid synthetic materials and wherein a stretched paper or cloth fabric is mounted to the frame.

Yet another object is to provide an improved design which is flexibly adapted for use and operation in different arrangements within the same window opening.

These and other objects will become apparent from the following detailed description of the invention including the references which will be made to the accompanying drawings.

BRIEF DESCRIPTION OF THE DRAWINGS

FIGS. 5 and 5A are detail views showing relationships between adjacent or contiguous panels included in the invention;

FIGS. 8 and 8A are diagrammatic views showing several elevated and descended positions of the panels in the set;

DETAILED DESCRIPTION OF THE INVENTION

Figure 1:
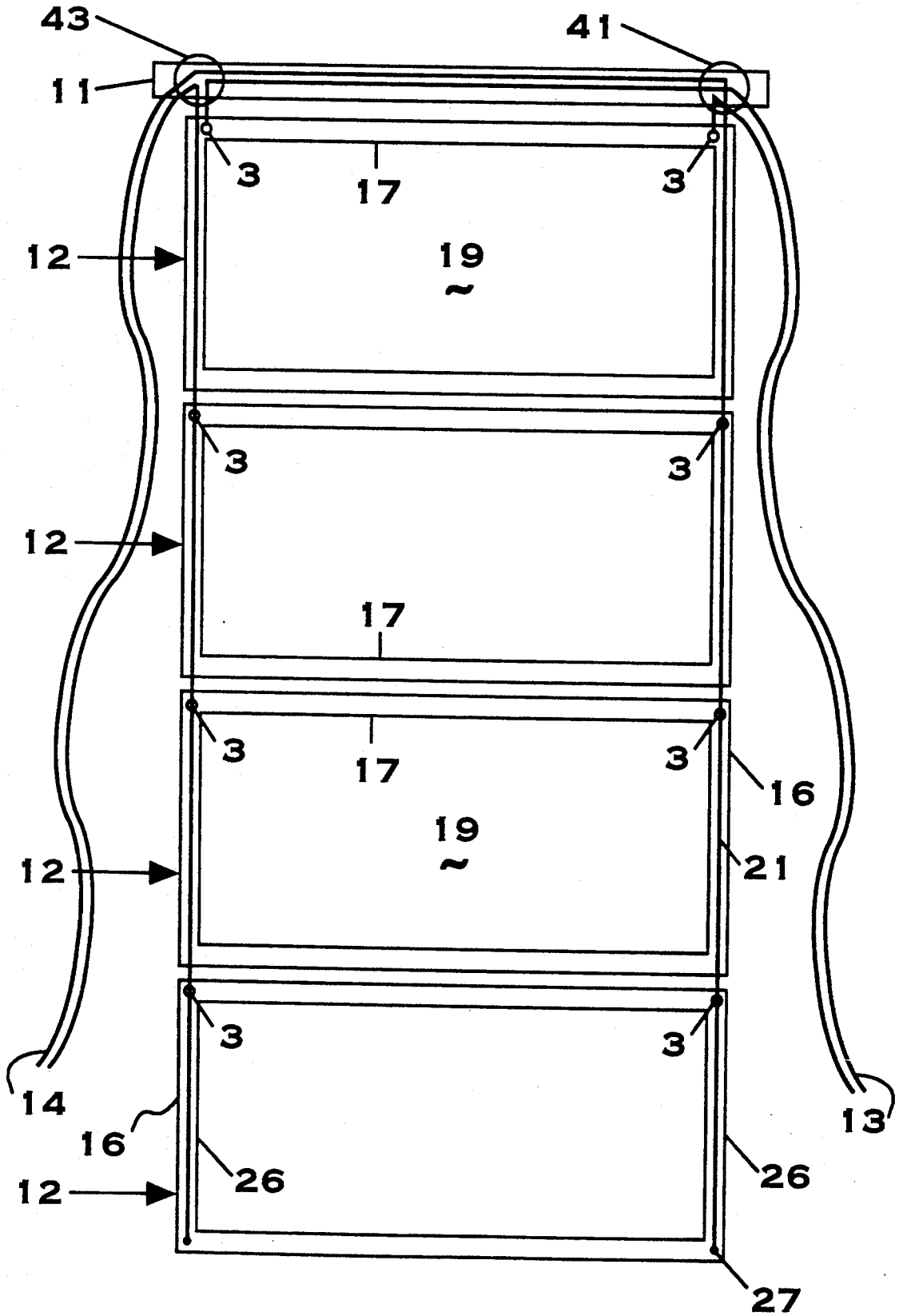
FIG. 1 is a rear elevation view of an articulated panel window covering system made in accordance with and embodying the principles of the present invention.
Figure 2:
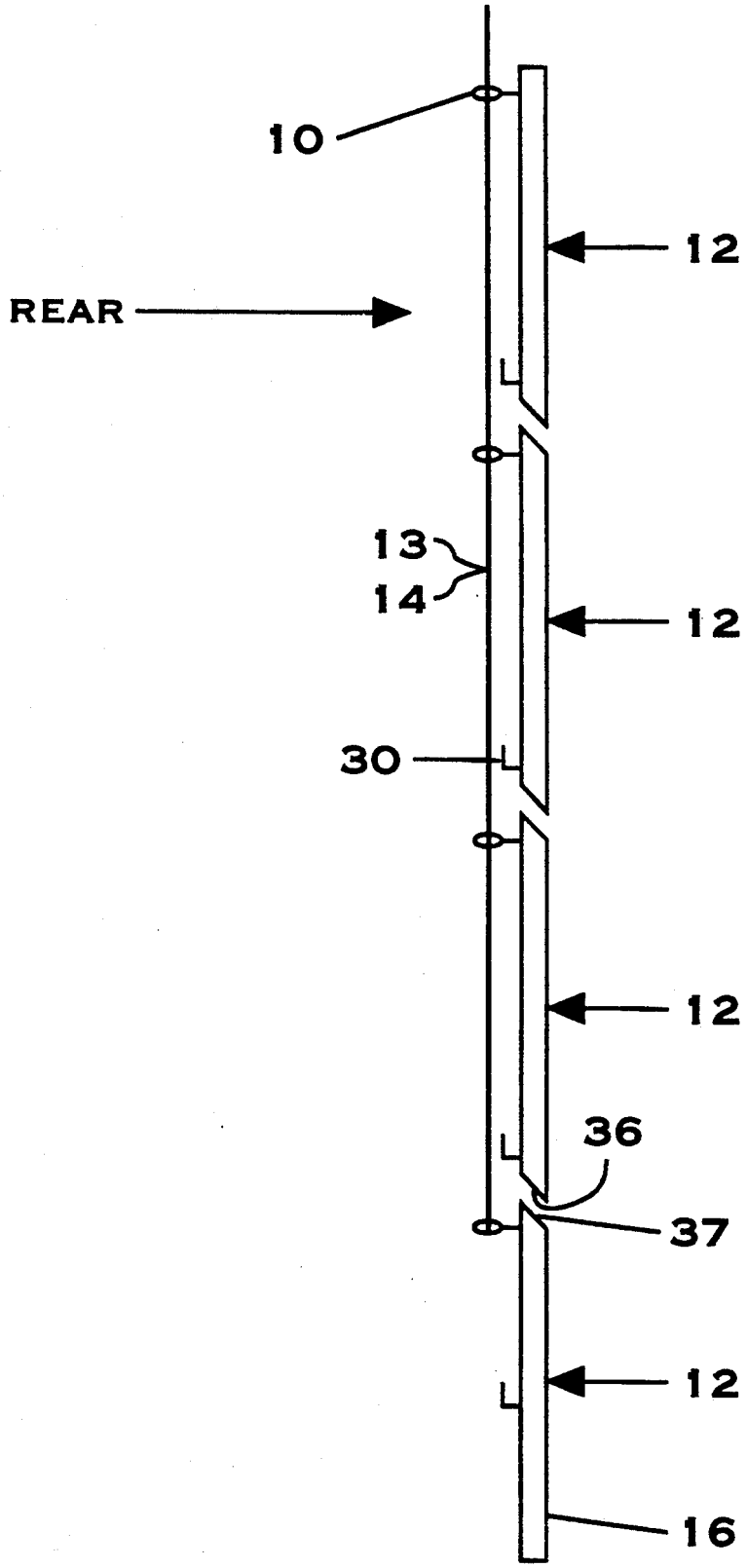
FIG. 2 is a side view of the window covering system of FIG. 1.

Referring to FIGS. 1 and 2 of the drawings, a system of articulated window covering panel 10 comprises a header member 11 adapted for mounting in a building such as a house and the like (not shown) adjacent to the casing for a window or door opening with which the panel that is to be associated. Additionally the panel 10 includes a plurality of substantially identical individual panels 12, a pull cord arrangement 13 for elevating the panels and a drop cord arrangement 14 operative for causing the panels to descend with respect to the horizontally disposed header 11.

Figure 3:
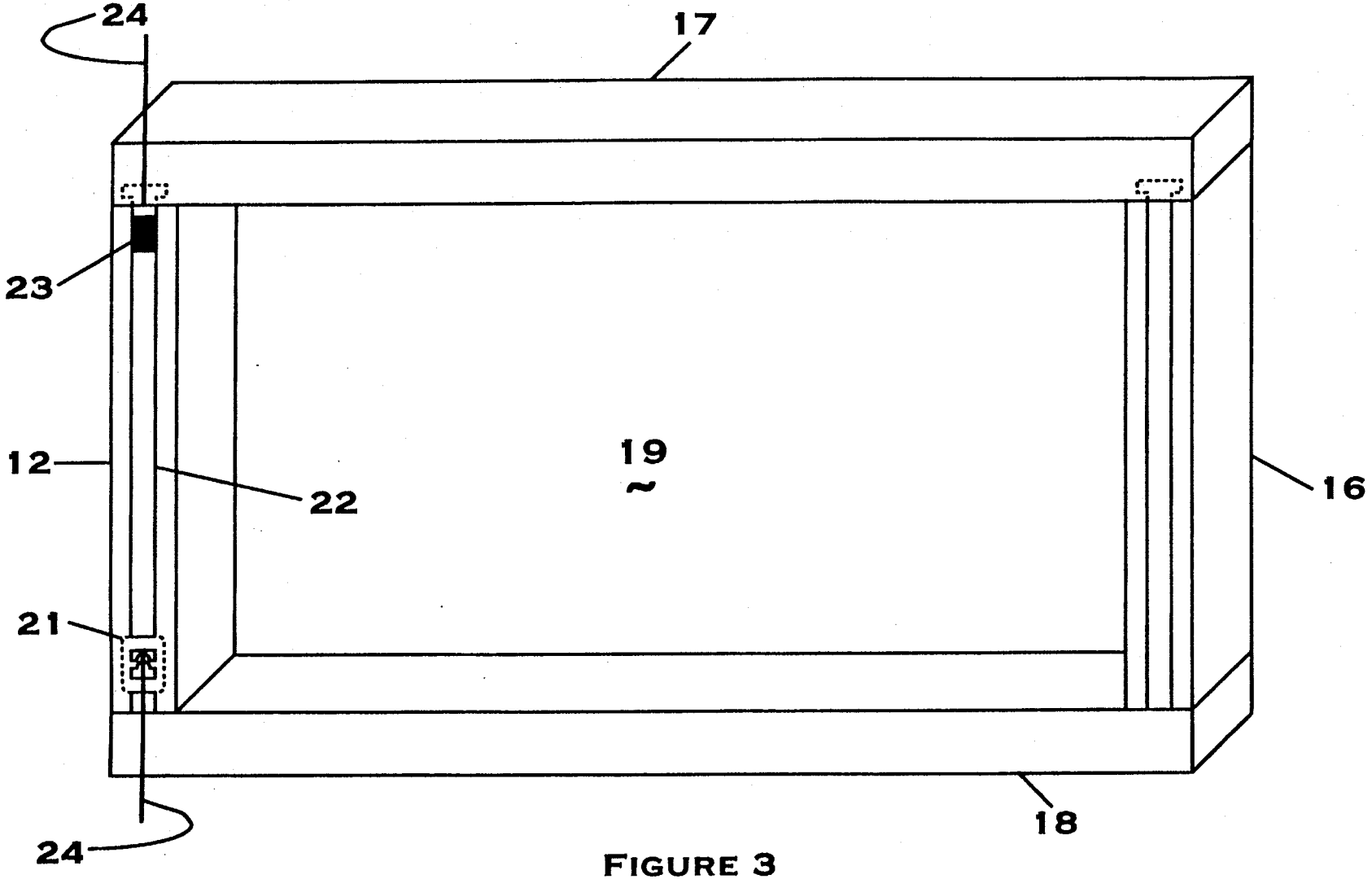
FIG. 3 is an elevational view of a typical panel included in the present invention.

A typical panel 12 shown in FIG. 3 includes a left and right side generally vertically-extending rails or stiles 16 fixedly connected to upper and lower frame bars 17 and 18 thereby defining a generally rectilinear, substantially rigid frame onto which a fabric 19 may be mounted such as by gluing, stapling or securing to the frame by wedging into a slot 20 (FIG. 4) in the manner of constructing a "silkscreen". The fabric may be an attractive Japanese silk, a cotton fabric bearing a design extending over the full array of panels or a paper material selected by the interior decorator or architect.

It will be understood that the several panels 12 are constructed and arranged to descend one after the other from the header member 11 in a sequence substantially as illustrated in FIG. 8 where four different descended arrangements are shown. Starting at the left-hand diagram in FIG. 8, all four of the panels 12.1, 12.2, 12.3, and 12.4 are shown suspended in a descended condition from the header 11. In the second illustration, panel 12.1 has been drawn upwardly to nest behind panel 12.2, and in the third illustration, panels 12.1 and 12.2 have both been drawn up to nest behind panel 12.3. In the fourth illustration, panels 12.1, 12.2, and 12.3 have been all drawn up to nest behind panel 12.4 through action of the pull cords 13, the arrangement of which will be described more fully below.

A somewhat converse operation of the panels with respect to the header member 11 is illustrated in FIG. 8A wherein in the first illustration on the left, panel 12.4 has been released by the drop-cords 14 to descend behind panel 12.3. In the second illustration from the left, panels 12.4 and 12.3 have been permitted to descend by gravity behind panel 12.2 thereby leaving an expanse of uncovered window disposed between the upper margin of panel 12.2 and the header 11. In the third illustration from the left of FIG. 8A, panels 12.4, 12.3, and 12.2 have all nested together behind panel 12.1 exposing even more of the window opening. In the fourth illustration from the left of FIG. 8A, all four panels in the nested condition have been dropped below the window frame to be in a completely out of the way, unobstructing condition. Having in mind these principles of operation of the panel system will readily permit an understanding of the function of the several elements which permit the conditions described above.

Figure 4:
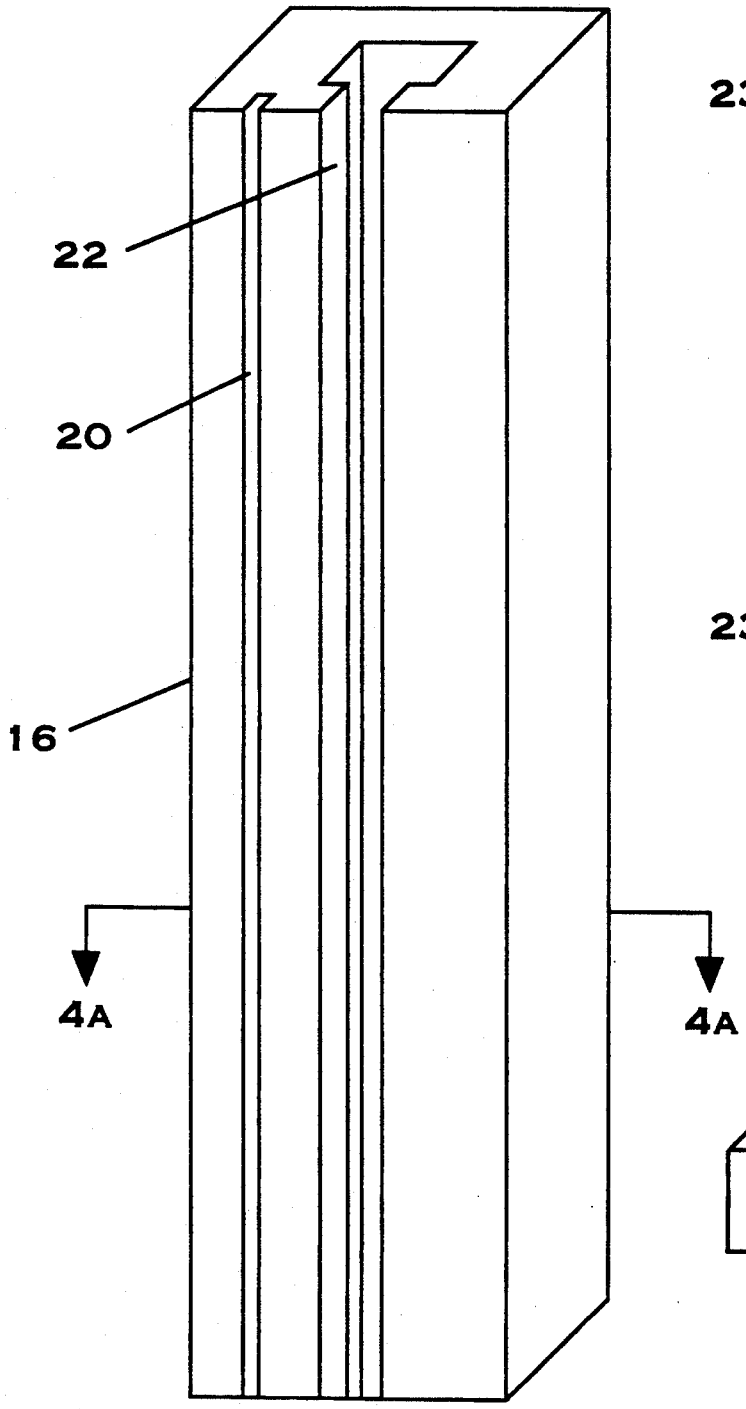
FIG. 4 is an enlarged detail view of a side rail or stile included in one form of the invention.
Figure 4C:
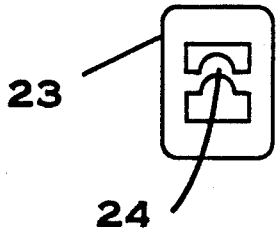
FIGS. 4B and 4C are detail views of one form of slider member included in the invention.
Figure 4B:
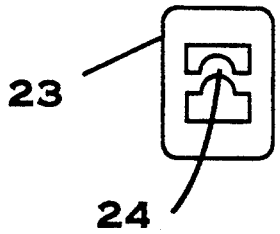
Figure 4A:
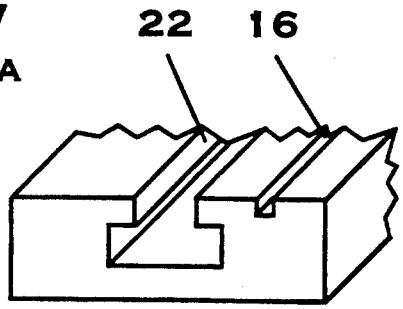
FIG. 4A is a sectional view in the direction of the arrows 4*a*—4*a* of FIG. 4.

To ensure that the panels are maintained in general vertical alignment when ascending or descending as viewed in FIGS. 8 and 8A, and in repose, guide means 21 are arranged on the side rails or stiles 16, as shown in FIGS. 3 and 4. Each guide means 21 includes an elongated portion 22 extending longitudinally of the side rail 16 and it may consist of a keyway routed into the stile 16 in the case of wood construction, or an extruded formation should the stile or side rail 16 be either an extruded metal or synthetic plastic material. A slider member 23 formed complementary to the keyway or elongate portion 22 is arranged in the keyway and carries a cord 24 which connects to a similar slider 23 similarly arranged in the next adjacent panel 12. Alternatively, the cord 24 may be anchored on the frame of the adjacent panel 12.

Another form of guide means 21 is shown in FIG. 1 and comprises a pair of cords 26 stretched along the side rails 16 and anchored to the frame by a suitable fastener such as an eyelet 27. The uppermost ends of the cords 26 are equipped with loops 28 which extends in an encircling relationship to the guide cord 26 on the panel arranged thereabove. As the lower panel, for example, is urged upwardly, the guide loops 28 slide along the guide cords 26 until encountering a stop eyelet 27 at which point travel is arrested.

Figure 9:
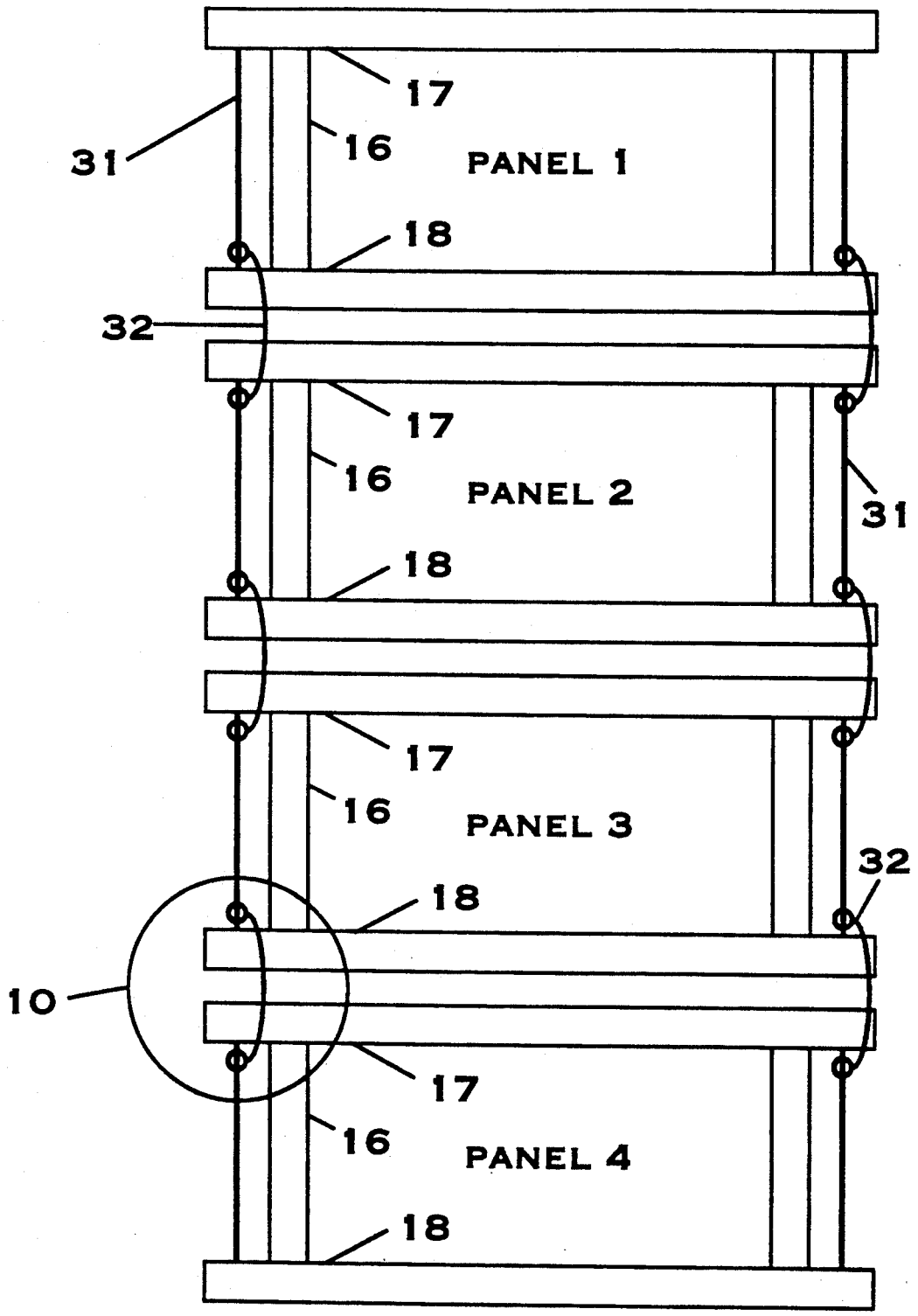
FIG. 9 is a view like FIG. 1 showing another guide means useful in the invention.
Figure 10:
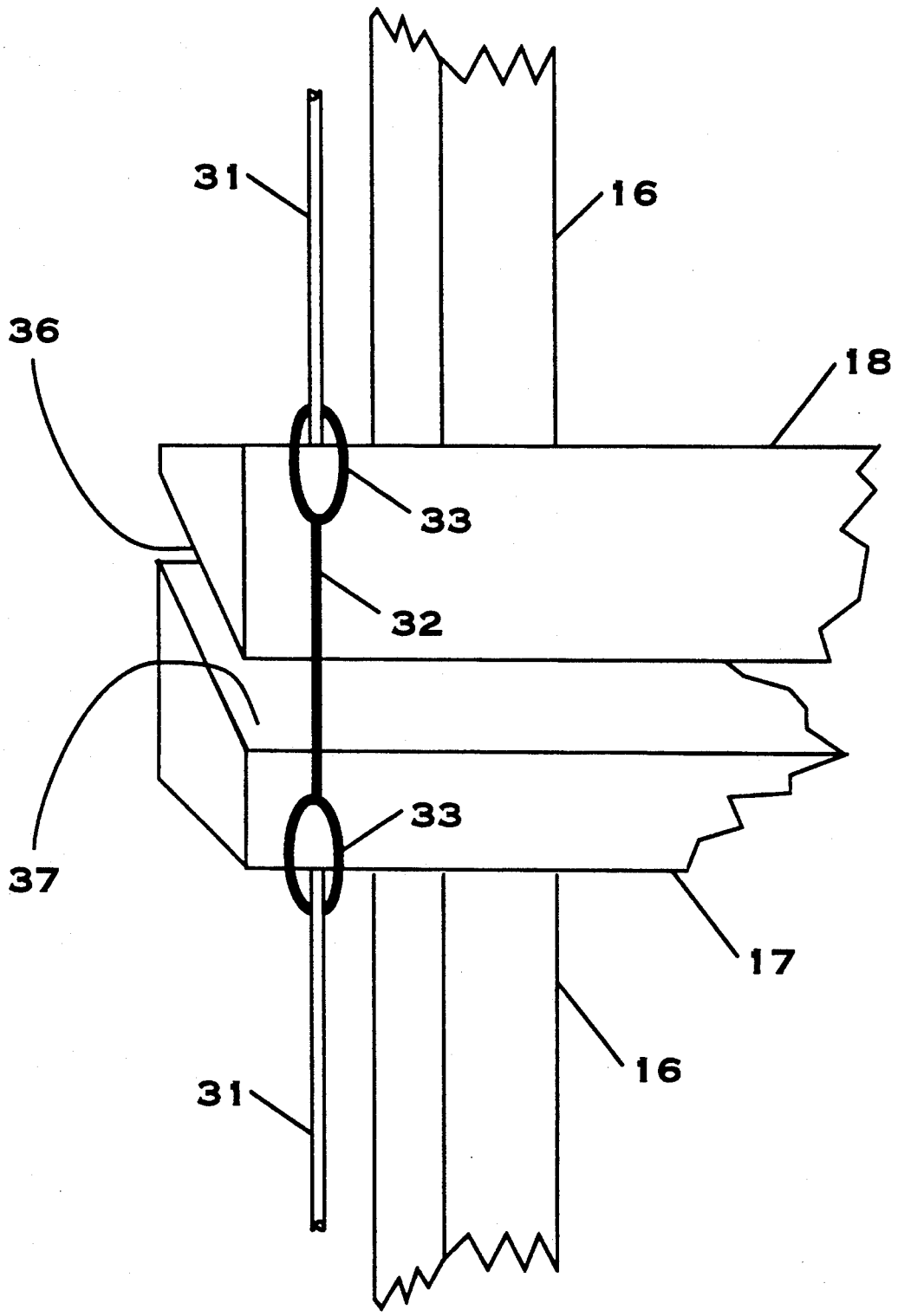
FIG. 10 is an enlarged detail view of the encircled area 10 from FIG. 9.

Yet another form of guide means 21 is shown in FIGS. 9 and 10 and comprises the vertically-extending guide rods 31 mounted along the side rails 16 and are anchored upon the upper and lower frame bars 17 and 18. Connecting the guide rods in adjacent panels are the slider cord members 32 each having ends containing loops 33 encircling a guide rod 31, as shown in FIG. 10.

It will be understood that the length of the connecting cords 24, 32 as well as the distance between the loops 33 of the sliding cord member 32 is selected so that when the panels are in the extended condition as shown in FIGS. 1 and 2, the lower frame bar of an upper panel is closely adjacent to the upper frame bar 17 of the panel therebelow with the frame bars being substantially parallel. L-shaped clips 30 (FIG. 2) mounted on the edge of the stiles 16 of the upper panels maintain the panels 12 in a parallel nested condition when the panels are juxtaposed.

Figure 7:
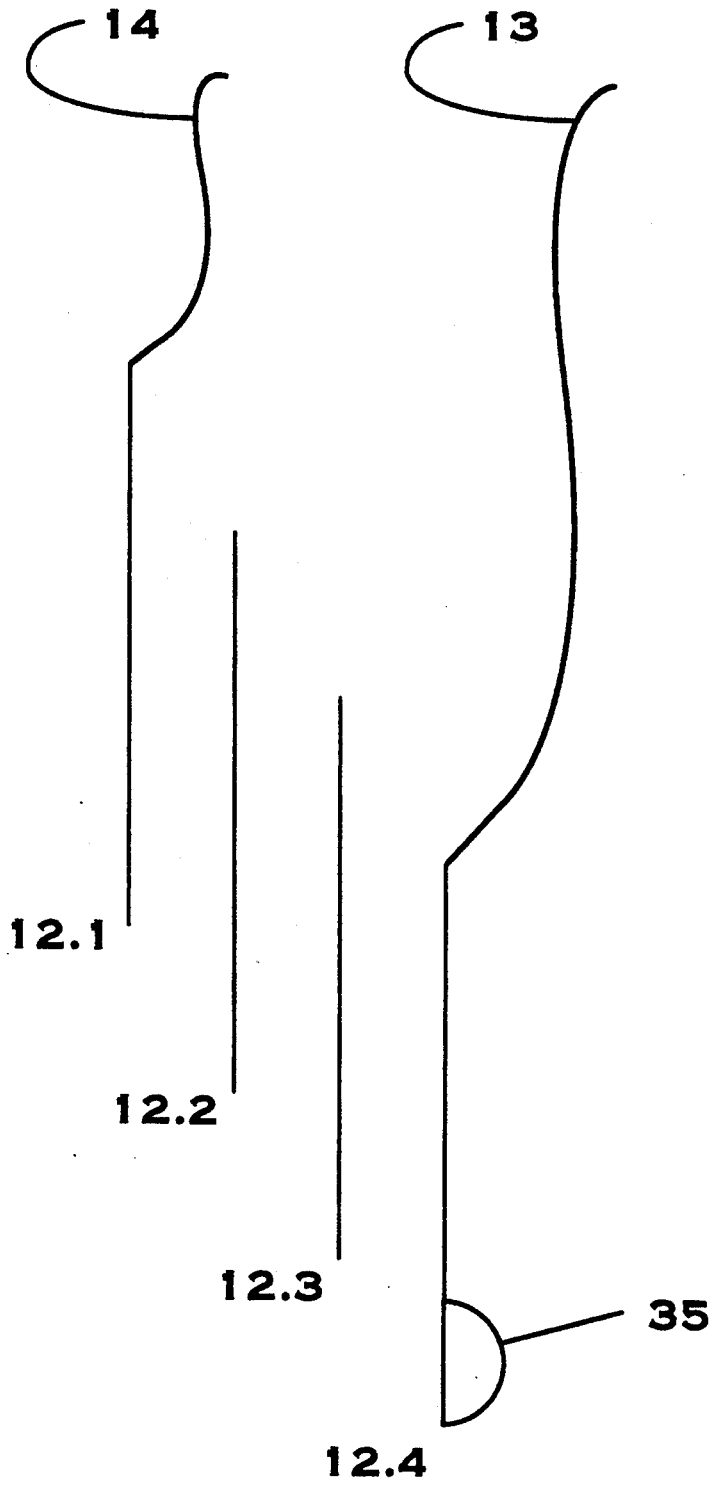
FIG. 7 is a diagrammatic end view showing a counterweight mounted upon a lower frame bar of a panel.

In FIG. 7, a balance weight 35 is shown mounted on the lower frame bar 18 of the lowermost panel 12.4. The weight urges the panels to nest together in a generally parallel condition. The weight 35 is substantially equal to the total weight of the several panels 12 in the set.

Figure 5:
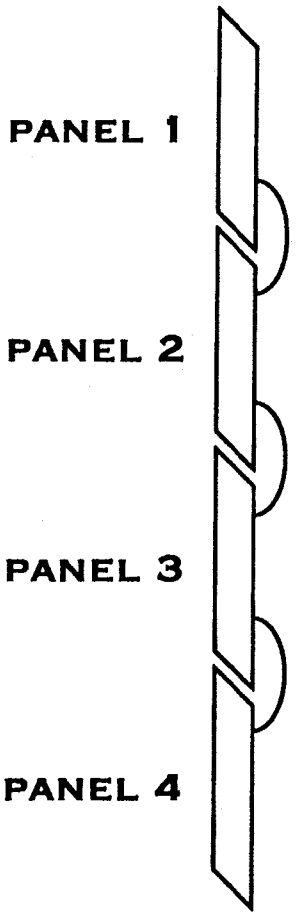
Figure 5:
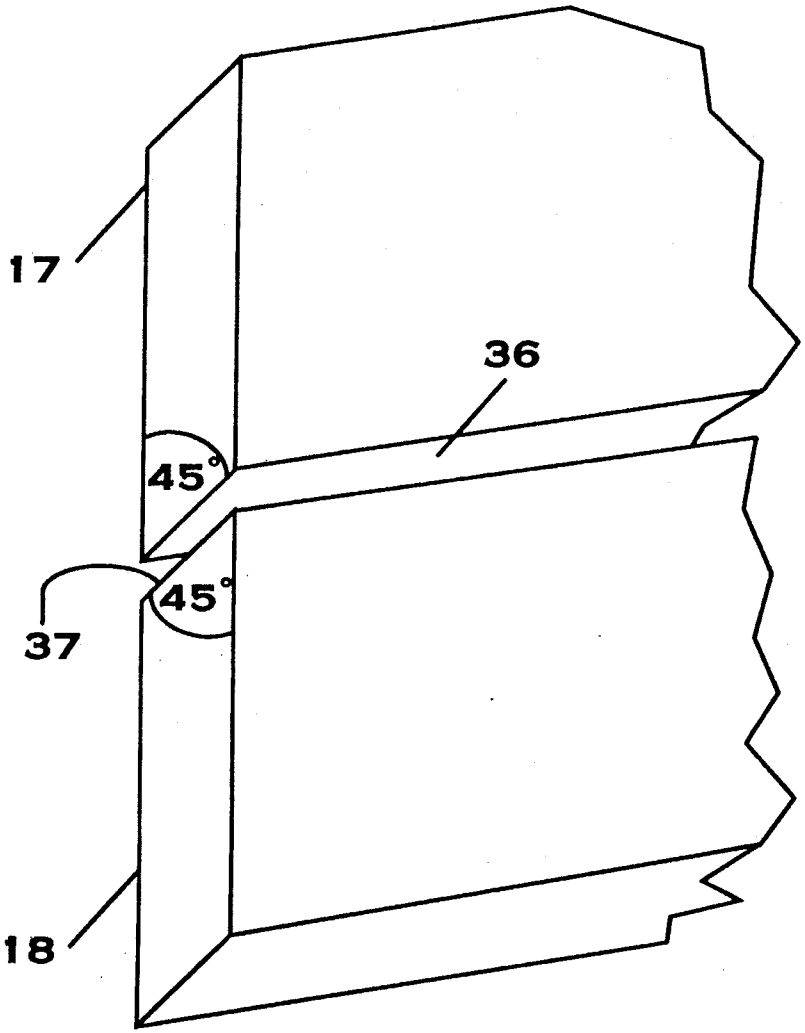

Guide surfaces 36 and 37 are arranged respectively on the upper frame bar 17 and the lower frame bar 18, the guide surfaces being complementary in beveled arrangement as shown in FIGS. 2, 5, and 10. For example the surfaces 36 and 37 may be beveled at 45° as shown in the drawings of FIGS. 5 and 10 or the complementary surfaces may be rounded into cam-face shape so that when upper frame member is moved up against the lower adjacent frame member the surfaces 36 and 37 will cam together urging the lower panel laterally outwardly so as to move up behind the panel thereabove. A further advantage of a 45° beveled surface is that when the panels are in their deployed condition the overlap in the bevel conceals the joint between adjacent panels rendering such joints substantially light-proof it has been found.

Figure 6:
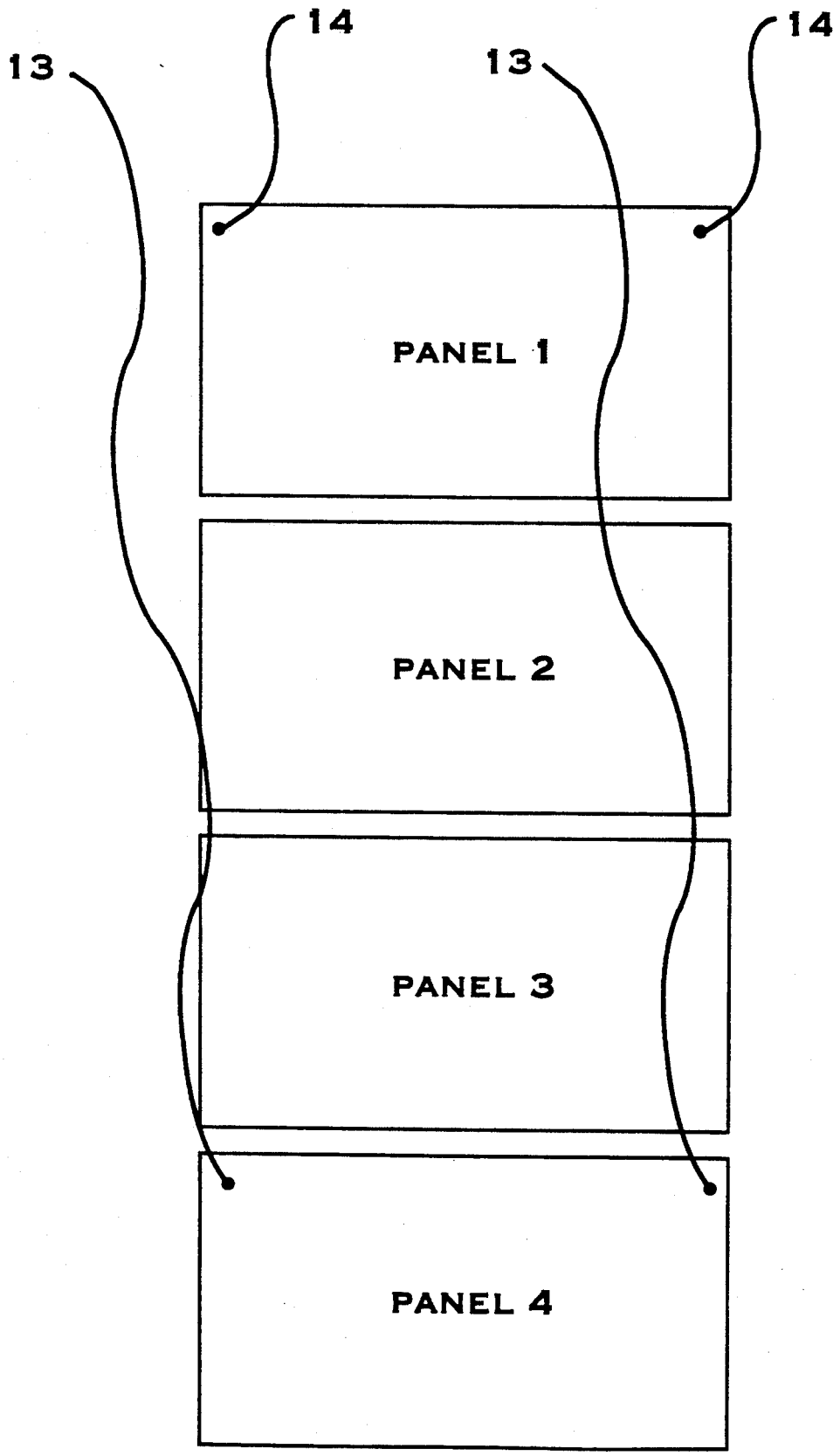
FIG. 6 is a view like FIG. 1 showing diagrammatically the cord system for raising and lowering the panels.

Referring to FIGS. 1, 2 and 6 the pull cord arrangement 13 comprises a pair of cords which reeve through a cord lock 41 mounted in the header member 11 and then diverge with one cord extending the length of the header 11 to then change direction over a roller 42 and to extend downwardly along the panels 12 being reeved through eyelet guide means 27 or the like to be anchored at the lowermost panel along the upper frame bar. Similarly the other pull cord 13 is reeved down along the opposite side rails of the panels for anchoring at the other end of the upper frame bar 17 on the lower panel 12. Applying pulling tension to the pull cords 13 causes the lowermost panel to move upwardly over the next lowermost panel, etc., until the panels are disposed in the selected one of the conditions shown in FIG. 8.

The drop cord members 14 are reeved through a cord lock 43 mounted on the header bar 11, FIG. 1, with the ends of the pull cords anchored to the uppermost panel 12 at the upper frame bar 17. The cords 14 are reeved so that one is anchored on each side of the frame bar 17 so that the entire panel set may be raised or lowered as a unit to take on one of the various positions as illustrated in FIG. 8A and as described more completely above.

It will be understood from the above that there has been disclosed and illustrated an improved system of window covering panels which is easy to assemble and operate and which is attractive in appearance, fulfilling the objects set out above. While certain preferred embodiments of the invention have been illustrated and described herein it will be seen that a number of the objects as set forth may be as readily and efficiently obtained when certain changes are made in the above-described construction, without departing from the scope of the invention. It is intended that all matter contained in the description or shown in the accompanying drawings shall be interpreted as illustrated, and not in a limiting sense.

What is claimed is:

1. A set of panels for providing a window covering or blinds comprising, a header member serving to mount the panel set with respect to a window opening on the inside window frame;

the panels in the set each comprising a generally rectilinear, substantially rigid frame and a fabric-like material mounted upon the frame serving to provide a light occluding effect or a selected aesthetic effect, the panel frame including upper and lower frame bars and a pair of spaced apart side rails connected to the frame bars, vertical guide means arranged on each panel extending along the side rails serving to guide consecutive panels in the set into an overlying, juxtaposed condition when the set is arranged in a minimally light occluding position as well as to guide consecutive panels into a deployed, aligned generally planar, contiguous position when the set of panels is disposed in a maximally light occluding position, said guide means including an elongate, stationary portion on one panel cooperable with a slider member carried by an adjacent panel movable along the elongate portion as the panels in the set are raised or lowered with respect to each other, and guide surfaces on the upper and lower frame bars on panels consecutive in the set serving to promote sliding a lower panel onto one side of the next adjacent panel and into an overlying position so that all panels in the set may nest together into an area of vertical plane not substantially larger than the area of a typical panel, the guide surfaces being generally complimentary, confronting, substantially beveled surfaces on adjacent frame bars, and a cord system connected to the panel set for raising and lowering the panel set with respect to the header member.

2. A panel set according to claim 1 wherein said cord system is configured with respect to said header member so that the panel set as a unit, with the panels displayed in a fully extended condition with substantially all panels disposed in substantially the same vertical plane, may be raised and lowered with respect to the header member.

3. A panel set according to claim 1 and further providing keeper means laterally spaced apart on a pair of the side rails of one of said panels and extending normal to the plane of said panel serving to maintain a generally parallel relationship with an overlying panel as the panels are juxtaposed for raising or lowering.

4. A panel set according to claim 1 and including counter-balance weight means disposed on one of the lower ones of said frame bars serving to maintain a generally parallel relationship with an overlying panel as the panels are juxtaposed for raising or lowering.

5. A panel set according to claim 1 wherein said vertical guide means comprises a pair of laterally spaced apart guide rods secured to the side rails in a generally parallel relationship on one of the panels in the set and said slider member is formed to encircle the guide rod for easy sliding action there-along as one panel is moved with respect to a consecutive panel.

6. A panel set according to claim 1 wherein said vertical guide means comprises a pair of laterally spaced apart cords fixed to the side rails and extending there-along in a generally taut condition and said slider members comprise loops of cord material encircling said cords for easy sliding action there-along as one panel is moved with respect to a consecutive panel.

7. A set of panels for providing a window covering or blinds comprising, a header member serving to mount the panel set with respect to a window opening on the inside window frame;

the panels in the set each comprising a generally rectilinear, substantially rigid frame and a fabric-like material mounted upon the frame serving to provide a light occluding effect or a selected aesthetic effect, the panel frame including upper and lower frame bars and a pair of spaced apart side rails connected to the frame bars, vertical guide means extending along the side rails serving to guide panels in the set into an overlying, juxtaposed condition when the set is arranged in a minimally light occluding position as well as into an aligned extended panel contiguous position when the set of panels is disposed in a maximally light occluding position, said guide means including an elongate slot extending substantially the length of the guide rail on one panel co-operable with a slider member carried by an adjacent panel movable along the elongate slot as the panels in the set are raised or lowered with respect to each other, said slider member being configured and arranged in the slot for sliding action therealong, and guide surfaces on the upper and lower frame bars on panels consecutive in the set serving to promote sliding a lower panel onto one side of the next adjacent panel and into an overlying position so that all panels in the set may nest together into an area of vertical plane not substantially larger than the area of a typical panel, the guide surfaces being generally complimentary, confronting, substantially beveled surfaces on adjacent frame bars, and a cord system connected to the panel set for raising and lowering the panel set with respect to the header member.

* * * * *